United States Patent [19]

Gaddy

[11] Patent Number: 4,828,305

[45] Date of Patent: May 9, 1989

[54] TAIL BLOCK ASSEMBLY FOR CARPET STRETCHES

[75] Inventor: Arthur K. Gaddy, Baird, Tex.

[73] Assignee: Gaddy Company, Baird, Tex.

[21] Appl. No.: 166,447

[22] Filed: Mar. 10, 1988

[51] Int. Cl.[4] ..... A47G 47/04

[52] U.S. Cl. ..... 294/8.6; 254/200; 254/209; 254/211; 254/212

[58] Field of Search ..... 294/8.6; 254/200, 201, 254/202, 203, 204, 205, 206, 207, 208, 209, 210, 211, 212

[56] References Cited

U.S. PATENT DOCUMENTS 2,606,743 8/1952 Owens ..... 254/212

4,577,837 3/1986 Berg et al. ..... 254/212

*Primary Examiner*—James B. Marbert

*Attorney, Agent, or Firm*—Eric P. Schellin

[57] ABSTRACT

A device for holding a conventional carpet stretcher and providing a tail block footing against a wall. The tail block is mounted on rollers and has a short tubular extension whereby one or more tubular extensions may be mounted thereon with the far terminal end being mounted against the conventional stretcher.

1 Claim, 1 Drawing Sheet

TAIL BLOCK ASSEMBLY FOR CARPET STRETCHES

BACKGROUND OF THE INVENTION

In the installation of wall to wall carpets it has long been recognized that it is necessary to physically urge or stretch the end of the carpet into position, that is, against one wall. When appropriately tensioned the carpet is then held in place as by suitably adhered tacking strips or the like.

The stretcher when applied to the end of the carpet must be braced against a wall opposite to the side to which the tension or stretching effort is being applied. A conventional stretcher has a foot having a plurality of downwardly depending spikes which are inserted through a portion of the carpet, by means of which the end portion of the carpet is suitably grasped.

FIELD OF THE INVENTION

The present invention relates to a device which is applied to a conventional carpet stretcher at one end thereof and has a tail block which is held in abutment against a wall opposite to the free side or side grasped by the stretcher.

A plurality of elongated reinforced tubes are hingedly attachable to the tail block at one end and to the said conventional stretcher at the other end.

SUMMARY OF THE INVENTION

The device includes an elongated tail block which has two rollers depending therefrom for rolling on a surface to and fro along its elongated axis.

The tail block is generally hollow. It is padded at its vertical ends and along one major side so that it can be positioned against a baseboard or wall without marring the surface. The other major side of the tail block has a relatively large recess. A short tube is hingedly attached is said recess in a manner whereby the short tube may swing out horizontally from said tail block and out of said recess. The short tube therefore swings on a vertical axle which is journalled centrally in the said recess of the tail block.

The short tube may have attached thereto one or more of a series of tubular attachments. The tubes are designed to telescope and the tubes are provided with appropriately positioned detents whereby a gross distance selection may be made for the carpet stretcher which then itself is manipulated for the fine selection to achieve the desired results.

BRIEF DESCRIPTION OF THE INVENTION

DETAILED DESCRIPTION OF THE INVENTION

The assembly includes a tail block 11 at one end. The tail block 11 has a hollow elongated rectangular configuration. It has rollers 12 at the bottom for to and fro movement. It is padded with a U shaped pad 13 at the ends thereof and at the back side 14.

Figure 1:
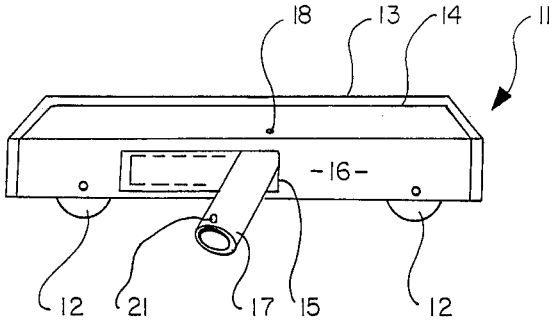
FIG. 1 is a perspective view of the tail block of the present invention.

The tail block has a rectangular shaped opening 15 at the front side 16 thereof. A short tube 17 is hingedly mounted on a vertical axle 18. The tube 17 may be pivotted into the tail block 11 through opening 15 and out of the opening 15 so that it is perpendicular to the tail block 11 and front side 16 as shown in the FIG. 1.

Figure 2:
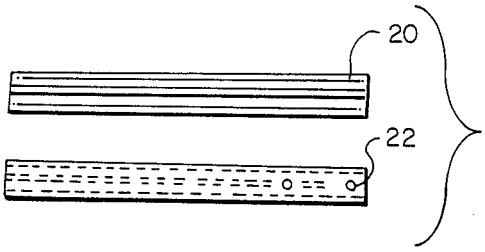
FIG. 2 is a view of a series of tubes that are assembled to form a bracing means for a conventional stretcher.

One or more tubes 20 as shown in FIG. 2 can be fitted into short tube 17. Short tube 17 has an opening 21 at the outwardly extending portion thereof for receiving a spring loaded button 22 in tube 20 so that one tube 20 may fit thereinto.

Figure 3:
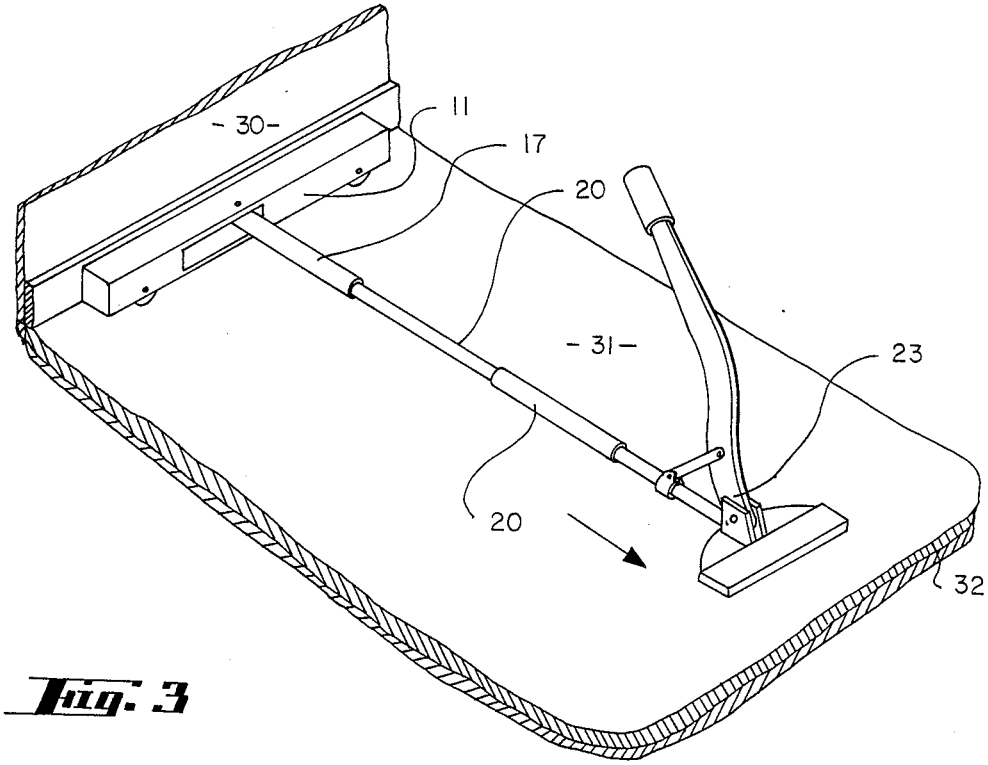
FIG. 3 is a perspective view of the assembly in use with a conventional stretcher at an end and the tail block at the other end.

The tube extension may be further lengthened by applying to the end portion of a first tube 20 with another tube 20. Finally as depicted in FIG. 3 the end portion of a conventional stretcher 23 is inserted in the remotely extending tube 20.

The stretcher 23 is then manually manipulated in the usual way to stretch the carpet as desired. FIG. 3 depicts the tail block of an assembled device against wall 30. It then is stretched across the room over carpet 31 towards the edge 32 portion of the carpet.

The assembly is constructed of aluminim. The tubes 20 either have internal ribs 33 or externally thereof depending whether the tube 20 is of the external kind or of the internal kind.

What is claimed is:

1. A carpet stretcher holder comprising a tail block, said tail block having an elongated hollow rectangular configuration, said tail block has a vertical elongated first side, said side having an elongated rectangular opening, a short tube is hingedly mounted in said opening whereby said tube pivots horizontally, said short tube being dimensioned whereby it passes through said opening into repose in said tail block when said device is not in use and said short tube pivots outwardly to a perpendicular position when said tail block is in use, said tail block has at least two rollers extending downwardly, said short tube has at least two telescoping tubular extensions affixed thereto and where the distal end of the outermost tubular extension is adapted and constructed to permit a tail block to be affixed thereto and said one of said tubular extensions has a plurality of equidistantly spaced parallel radially outwardly extending ribs and said other tubular extension has internally thereof a plurality of equidistantly spaced parallel radially inwardly extending ribs.

* * * * *